US011859925B2

(12) United States Patent
Tissot et al.

(10) Patent No.: US 11,859,925 B2
(45) Date of Patent: Jan. 2, 2024

(54) PLATE FORMING PART OF A HEAT EXCHANGER, AND HEAT EXCHANGER COMPRISING AT LEAST ONE SUCH PLATE

(71) Applicant: Valeo Systemes Thermiques, Le Mesnil-Saint-Denis (FR)

(72) Inventors: Julien Tissot, Le Mesnil Saint Denis (FR); Kamel Azzouz, Le Mesnil Saint Denis (FR); Michael Lissner, Le Mesnil Saint Denis (FR); Cédric De Vaulx, Le Mesnil Saint Denis (FR); Patrick Leblay, Le Mesnil Saint Denis (FR); Sébastien Garnier, Le Mesnil Saint Denis (FR)

(73) Assignee: Valeo Systemes Thermiques, Le Mesnil Saint-Denis (FR)

( * ) Notice: Subject to any disclaimer, the term of this patent is extended or adjusted under 35 U.S.C. 154(b) by 0 days.

(21) Appl. No.: 17/279,127

(22) PCT Filed: Sep. 25, 2019

(86) PCT No.: PCT/FR2019/052260
§ 371 (c)(1),
(2) Date: Mar. 24, 2021

(87) PCT Pub. No.: WO2020/065217
PCT Pub. Date: Apr. 2, 2020

(65) Prior Publication Data

US 2021/0396479 A1 Dec. 23, 2021

(30) Foreign Application Priority Data

Sep. 25, 2018 (FR) ..... 1858765

(51) Int. Cl.
*F28F 3/08* (2006.01)
*F28F 3/04* (2006.01)

(52) U.S. Cl.
CPC ..... *F28F 3/086* (2013.01); *F28F 3/044* (2013.01); *F28F 3/048* (2013.01); *F28F 2250/102* (2013.01)

(58) Field of Classification Search
CPC ..... F28D 1/0341; F28D 1/0383; F28F 3/044; F28F 3/048; F28F 3/086
See application file for complete search history.

(56) References Cited

U.S. PATENT DOCUMENTS 2,705,617 A * 4/1955 Richard ..... A23C 3/0332 165/181
2002/0079093 A1* 6/2002 Rong ..... F28D 1/0341 165/174

(Continued)

FOREIGN PATENT DOCUMENTS

CA 2414804 A1 * 6/2004 ..... F28D 1/0341
CN 103759474 A 4/2014

(Continued)

OTHER PUBLICATIONS

Translation of Korean Patent Document KR2019970019242 entitled Translation—KR2019970019242 (Year: 2002).*

(Continued)

*Primary Examiner* — Paul Alvare
(74) *Attorney, Agent, or Firm* — Osha Bergman Watanabe & Burton LLP

(57) ABSTRACT

The invention relates to a plate (105) forming part of a heat exchanger and intended to delimit at least one channel (111) for circulation of a fluid. The plate (105) extends principally along an axis of longitudinal extent (A1). The plate (105) comprises at least one bottom (106), at least one first lateral raised edge (19*a*) which is inscribed within a first plane (P1) intersecting the axis of longitudinal extent (A1), and at least two openings (110) which are configured such that the fluid enters and exits the channel (111), respectively. The bottom (Continued)

Figure 1:
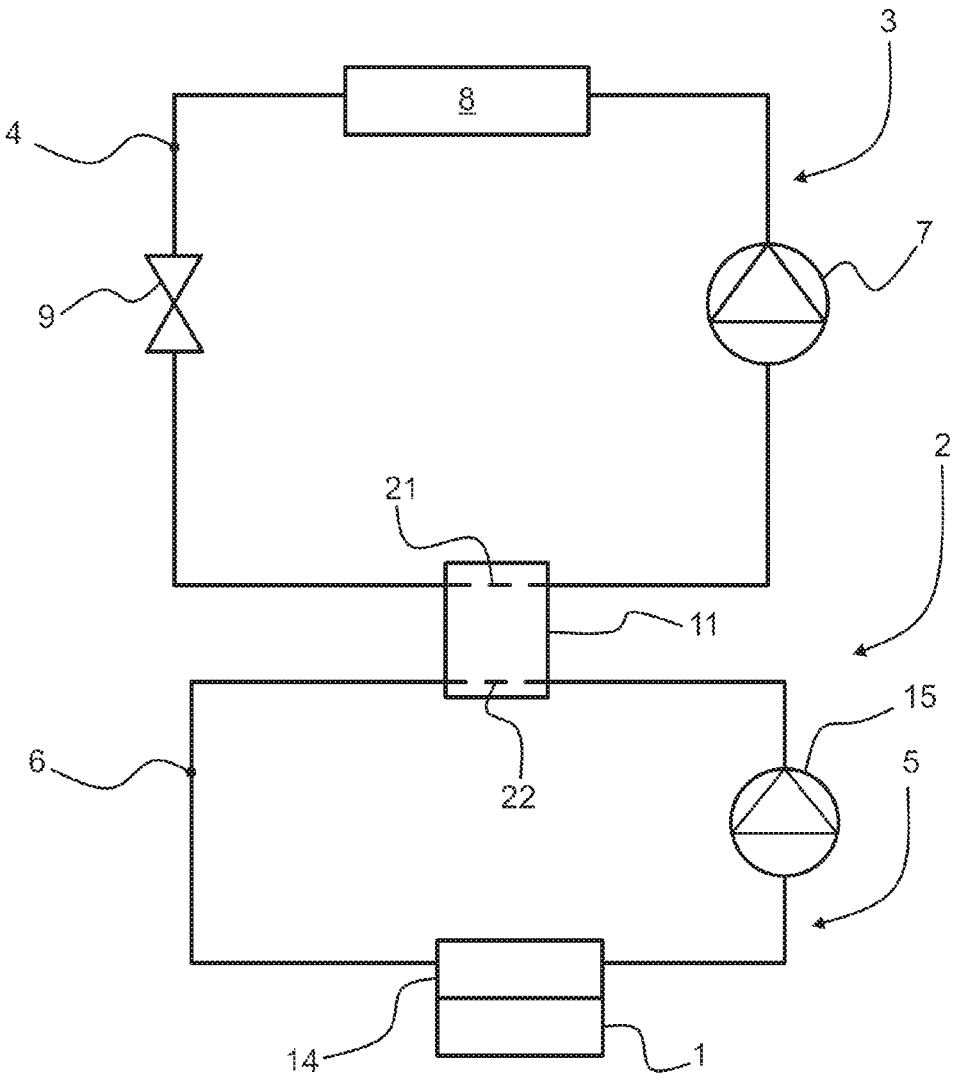

(106) is provided with a rib (113) which extends longitudinally from the first lateral raised edge (109*a*). The rib (113) is positioned between the two openings (110). The rib (113) is of a sinuous configuration.

9 Claims, 5 Drawing Sheets

(56) References Cited

U.S. PATENT DOCUMENTS

| | | | | |
|---|---|---|---|---|
| 2003/0116310 | A1* | 6/2003 | Wittmann | F28F 9/0273 165/176 |
| 2003/0192677 | A1* | 10/2003 | Rong | F28F 9/0265 165/152 |
| 2006/0231241 | A1* | 10/2006 | Papapanu | F28F 13/06 165/152 |
| 2007/0044946 | A1 | 3/2007 | Mehendale et al. | |
| 2014/0008046 | A1* | 1/2014 | Persson | F28F 3/042 165/185 |
| 2015/0053372 | A1* | 2/2015 | Seitz | F28F 3/12 165/41 |
| 2018/0017024 | A1* | 1/2018 | Hermida Domínguez | F28D 7/1684 |

FOREIGN PATENT DOCUMENTS

| | | | | | |
|---|---|---|---|---|---|
| CN | 103930742 | A | | 7/2014 | |
| DE | 102008014375 | A1 | | 9/2009 | |
| DE | 102014217728 | A1 | * | 3/2016 | B60K 11/02 |
| DE | 102015222775 | A1 | * | 5/2017 | |
| EP | 2175222 | A1 | | 4/2010 | |
| EP | 3270085 | A1 | * | 1/2018 | F02M 26/28 |
| EP | 3270085 | A1 | | 1/2018 | |
| KR | 19990005867 | U | * | 2/1999 | |
| KR | 200283451 | Y1 | | 9/2002 | |
| KR | 2019970019242 | | * | 9/2002 | |
| WO | WO-2010090557 | A1 | * | 8/2010 | F28D 9/005 |

OTHER PUBLICATIONS

Translation of Korean Patent Document entitled Translation—KR19990005867U (Year: 1999).*

Translation of German Patent Document DE102015222775A1 entitled Translation—DE102015222775A1 (Year: 2023).*

International Search Report issued in corresponding PCT Application No. PCT/FR2019/052260, dated Jan. 29, 2020 (5 pages with translation).

Written Opinion issued in corresponding PCT Application No. PCT/FR2019/052260, dated Jan. 29, 2020 (5 pages).

First Office Action in corresponding in Chinese Application No. 201980077288.3, dated Jun. 8, 2022 (15 pages).

* cited by examiner

PLATE FORMING PART OF A HEAT EXCHANGER, AND HEAT EXCHANGER COMPRISING AT LEAST ONE SUCH PLATE

The present invention relates to plates that form part of a heat exchanger. The subject matter concerns such a plate, and a heat exchanger having at least one such plate.

In the automotive sector, it is common to have to modify a temperature of an element such as an electric motor, a battery, a heat and/or cold storage device or similar. To this end, the motor vehicle is equipped with an installation which comprises a refrigerant circuit within which a refrigerant circulates, and a heat-transfer liquid circuit within which a heat-transfer liquid circulates. The refrigerant circuit comprises a compressor for compressing the refrigerant, a thermal exchanger for cooling the refrigerant at constant pressure, an expansion member to permit expansion of the refrigerant, and a heat exchanger which is arranged to permit a thermal transfer between the refrigerant and the heat-transfer liquid.

The heat exchanger is an exchanger formed of plates that are stacked and joined together in order to form a tube delimiting a circulation channel for the refrigerant or for the heat-transfer liquid. The heat exchanger is a U-shaped heat exchanger, in which the circulation paths of the refrigerant and of the heat-transfer liquid are arranged in a U shape. To this end, the plate is provided with a rib which delimits the branches of the U and which is positioned between the branches of the U. The plate comprises at least two openings for supplying the circulation channel with heat-transfer liquid or refrigerant. The circulation channel provides the heat-transfer liquid or the refrigerant with a passage section which is a surface taken perpendicularly to a plane in which the plate extends and perpendicularly to an axis of longitudinal extent of the plate.

A first problem lies in a poor distribution of the refrigerant and/or of the heat-transfer liquid inside the circulation channel. Poor distribution of this kind lessens the efficacy of the thermal transfer between the refrigerant and the heat-transfer liquid.

A second problem lies in too great a speed of circulation of the refrigerant and/or of the heat-transfer liquid inside the circulation channel, which also minimizes the thermal transfer between the refrigerant and the heat-transfer liquid.

It is known to form protuberances inside the circulation channel in order to disturb a flow of the refrigerant and/or of the heat-transfer liquid inside the circulation channel. The protuberances are obtained from a deformation of at least one of the plates.

However, there is still a poor distribution of the refrigerant and/or of the heat-transfer liquid inside the circulation channel, and also too great a speed of circulation of the refrigerant and/or of the heat-transfer liquid inside the circulation channel, at least inside a zone of the passage section of the refrigerant and/or of the heat-transfer liquid inside the circulation channel. The zone of the passage section inside which said speed of circulation is excessive is, for example, a corridor formed between the protuberances and the rib that the plate comprises.

An object of the present invention is to make available a plate forming part of a heat exchanger which permits optimization of a distribution of the refrigerant and/or of the heat-transfer liquid inside the circulation channel that the plate partially delimits.

Another object of the present invention is to make available a plate forming part of a heat exchanger which reduces a speed of circulation of the refrigerant and/or of the heat-transfer liquid inside the circulation channel, in a particular zone where the speed of circulation of the refrigerant and/or of the heat-transfer liquid inside the circulation channel is judged excessive.

Another object of the present invention is to make available a particular arrangement of the plate forming part of a heat exchanger in which a circulation path is arranged in a U shape, especially for a heat exchanger between a refrigerant and a heat-transfer liquid.

Another object of the present invention is to make available a heat exchanger comprising at least one such plate, the heat exchanger being a heat exchanger between a refrigerant and a heat-transfer liquid, such as a heat exchanger interposed between a refrigerant circuit and a heat-transfer liquid circuit.

A plate of the present invention is a plate forming part of a heat exchanger and intended to delimit at least one channel for circulation of a fluid. The plate extends principally along an axis of longitudinal extent. The plate comprises at least one bottom, at least one first lateral raised edge which is inscribed within a first plane intersecting the axis of longitudinal extent, and at least two openings which are configured such that the fluid enters and exits the channel, respectively. The bottom is provided with a rib which extends longitudinally from the first lateral raised edge. The rib is positioned between the two openings.

According to the present invention, the rib is of a sinuous configuration.

The plate advantageously comprises any one at least of the following technical features, alone or in combination:

- the rib is of a sinusoidal shape overall,
- the rib has a succession of humps and hollows that are visible in a plane parallel to a bottom plane in which the bottom is inscribed, the plane intersecting the rib. The rib has corrugations within said plane,
- the first lateral raised edge extends in the first plane, which is transverse to the bottom plane in which the bottom extends,
- the first lateral raised edge extends in the first plane which crosses the bottom plane and which intersects an axis of longitudinal extent of the plate,
- the first plane forms, with the bottom plane, a first angle of between 91° and 140°, preferably of between 91° and 95°,
- the plate comprises the bottom, which is bordered by a raised edge comprising at least two longitudinal raised edges formed opposite each other and at least two lateral raised edges formed opposite each other, the two longitudinal raised edges and the two lateral raised edges together forming a perimeter peripheral to the bottom,
- the rib is arranged such that the channel has a U-shaped profile,
- the channel is shaped as a U whose branches are parallel to the longitudinal raised edges of the plate and whose base lies next to a second lateral raised edge which is formed longitudinally opposite the first lateral raised edge,
- the rib is formed at an equal distance, +/−5%, from the two longitudinal raised edges of the plate, the distance being measured between a center of the rib and one of the longitudinal edges of the plate,
- the rib is offset by a non-zero distance with respect to a median plane of the plate, the median plane being orthogonal to the bottom plane and parallel to the axis of longitudinal extent of the plate, the plate is made of a metallic material able to be stamped in order to form in particular the rib and the protuberances by stamping of the plate, the metallic material being chosen from among the thermally conductive metallic materials, in particular aluminum or aluminum alloy, the rib comprises two longitudinal ends, of which a first longitudinal end is in contact with the first lateral raised edge and a second longitudinal end is provided at a non-zero distance from a second lateral raised edge, the first longitudinal end of the rib and the second longitudinal end of the rib are aligned along a first direction parallel to an axis of longitudinal extent of the plate, the rib has a summit which is positioned between two rib edges, the summit is inscribed within a plane which is parallel to the bottom plane, one at least of the rib edges comprises an alternating succession of convex portions and concave portions, the rib edges each have the shape of a corrugated sheet, a rib width, taken between the two rib edges and parallel to a bottom plane within which the bottom is inscribed, is constant from one to the other of the longitudinal ends of the rib, the bottom of the plate is provided with a plurality of protuberances, a first distance taken between a crown of a convex portion of the rib and the protuberance laterally nearest to the crown is between 200% and 300% of a second distance taken between a hollow of a concave portion of the rib and the protuberance laterally nearest to the hollow. It follows from this that the protuberance laterally nearest to the hollow is arranged in a corridor formed between one of the rib edges of the rib and a longitudinal alignment of the protuberances nearest to the crown, the protuberances are organized in a plurality of rectilinear rows of protuberances, the rectilinear rows of protuberances being formed along a second direction which is parallel to the axis of lateral extent of the plate, two successive rectilinear rows intersect a concave portion and a convex portion, respectively, of the groove, the protuberances are organized in a plurality of oblique rows of protuberances, the oblique rows of protuberances being formed along a third direction which is substantially orthogonal to the second direction, two successive oblique rows intersect a concave portion and a convex portion, respectively, of the groove, the plate has four openings, of which one opening is formed between the rib and a first longitudinal edge, one opening is formed between the rib and a second longitudinal edge, and two openings are formed between the first longitudinal edge and the second longitudinal edge, the openings are circular.

The present invention also relates to a heat exchanger comprising at least one such plate.

The heat exchanger advantageously comprises any one at least of the following technical features, alone or in combination:

two plates are engaged one inside the other, and a space that forms the circulation channel for the fluid is provided between the two plates, according to a design variant, at least three plates are engaged one inside another and delimit in pairs a first channel and a second channel, the first channel being configured to be used by a heat-transfer liquid while the second channel is configured to be used by a refrigerant, the heat exchanger comprises a first circulation path participating in a refrigerant circuit inside which a refrigerant circulates, and a second circulation path inside which a heat-transfer liquid circulates, the first circulation path and the second circulation path being arranged to permit a heat exchange between the refrigerant and the heat-transfer liquid. To this end, the bottom comprises a first face bordering the first circulation path and a second face bordering the second circulation path, the first circulation path and the second circulation path are arranged in a U shape, the heat-transfer liquid circuit comprises a thermal exchanger able to exchange heat energy with an element that is to be cooled and/or heated, such as an electric motor, a battery, a heat and/or cold storage device or similar.

Figure 2:
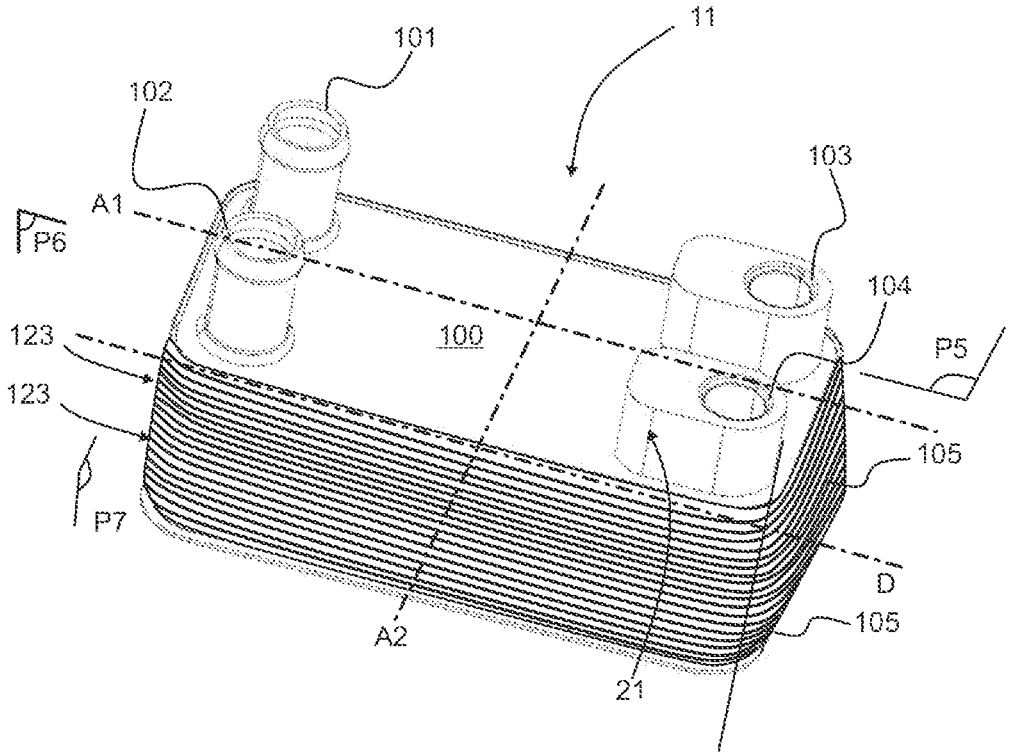
Figure 3:
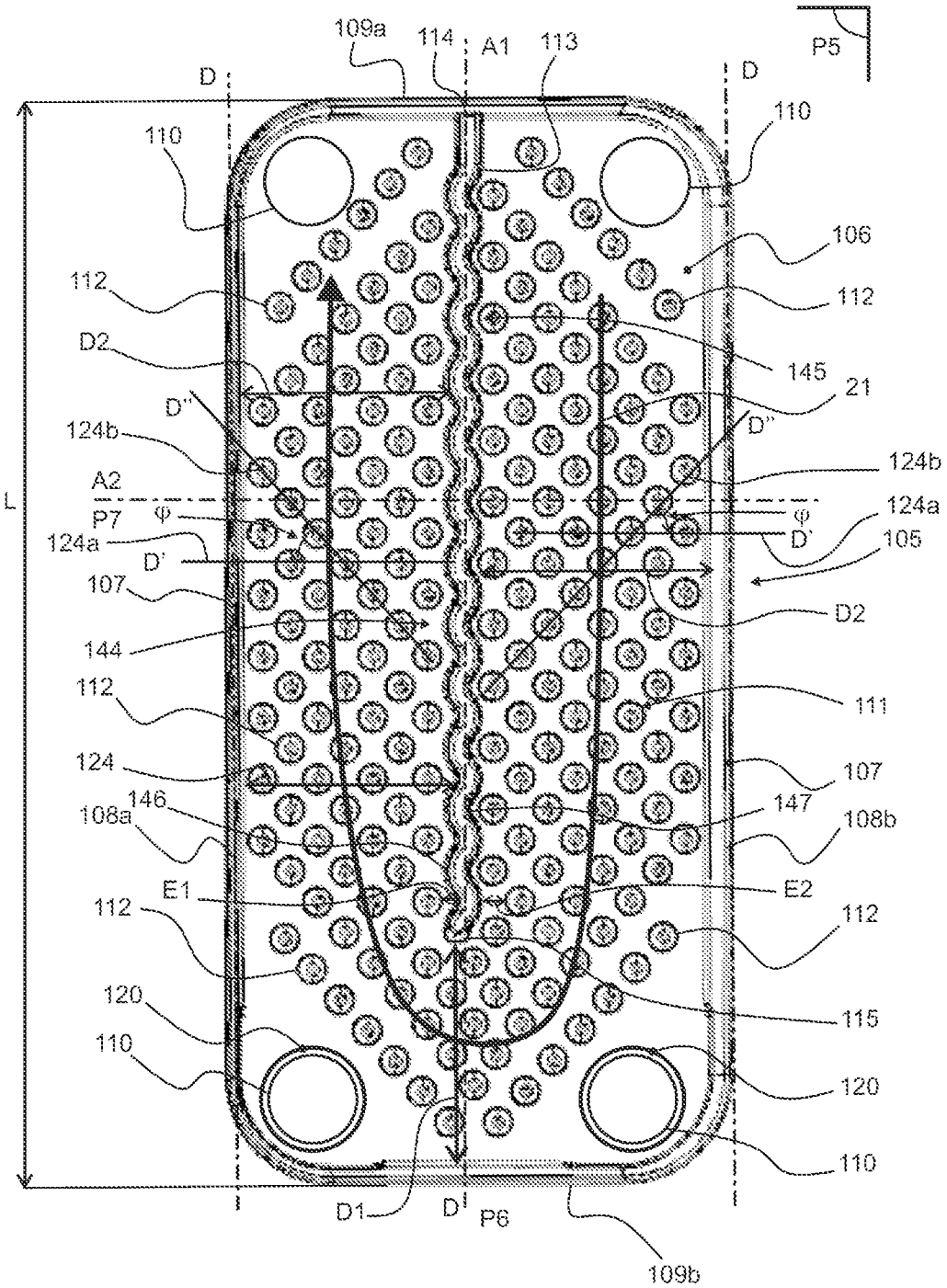
Figure 4:
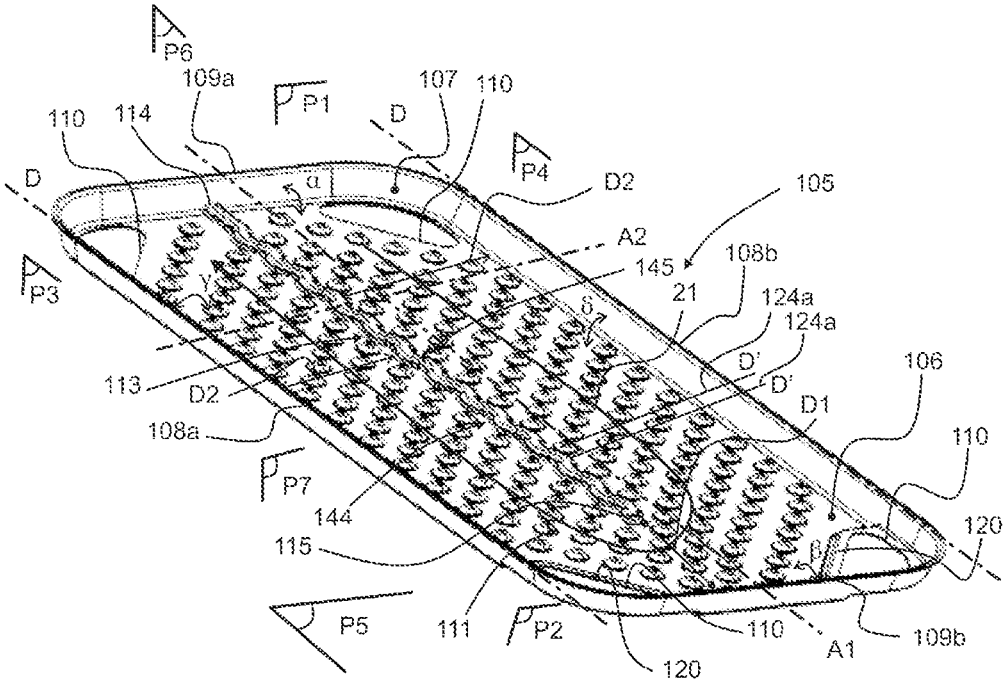
Figure 5:
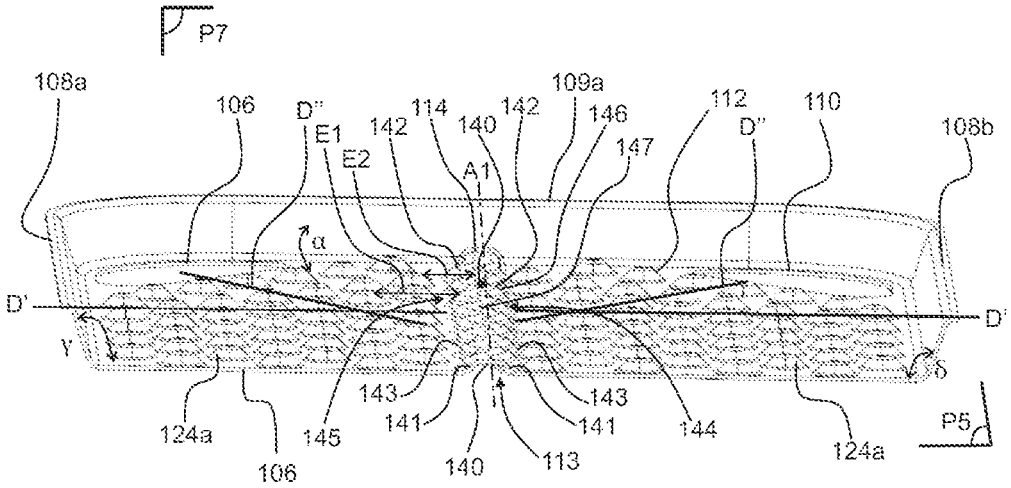
Figure 6:
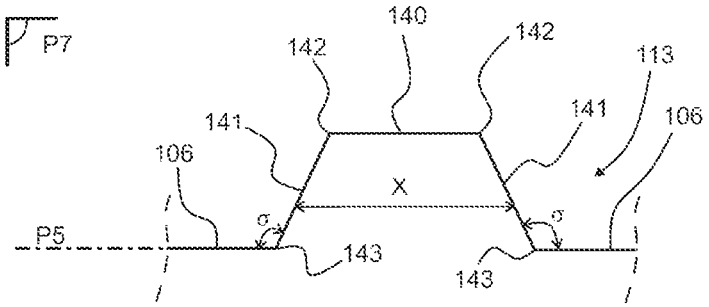

Further features, details and advantages of the invention will become more clearly apparent from reading the following description, which is provided by way of illustration and in which reference is made to the drawings, in which:

FIG. 1 is a schematic view of an installation comprising at least one heat exchanger according to the invention, FIG. 2 is a schematic view of the heat exchanger participating in the installation shown in FIG. 1, FIG. 3 is a schematic front view of a plate forming part of the heat exchanger illustrated in FIG. 2, FIG. 4 is a schematic view in perspective of the plate illustrated in FIG. 3, FIG. 5 is a schematic view of a transverse section, seen in perspective, of the plate illustrated in FIGS. 3 and 4, FIG. 6 is a schematic view of a transverse section of a rib with which the plate illustrated in FIGS. 3 to 5 is equipped.

It should first of all be noted that the figures set out the invention in detail for implementing the invention, it being of course possible for said figures to serve to better define the invention if necessary.

In FIG. 1, a motor vehicle is equipped with an element 1 which has to be cooled or heated, for example in order to optimize its functioning. Such an element 1 is in particular an electric motor or combustion engine intended to at least partially propel the motor vehicle, a battery provided to store electrical energy, a device for storing heat and/or cold energy, or similar. To this end, the motor vehicle is equipped with an installation 2 which comprises a refrigerant circuit 3 within which a refrigerant 4 circulates, for example carbon dioxide or the like, and a heat-transfer liquid circuit 5 within which a heat transfer liquid 6 circulates, in particular glycol water or the like. The installation 2 comprises at least one heat exchanger 11 according to the present invention. The installation 2 is described below in order to better understand the present invention, but the features of the described installation 2 are not limiting for the heat exchanger 11 of the present invention. In other words, the installation 2 is able to have distinct structural features and/or operating modes different than those described, without the heat exchanger 11 departing from the rules of the present invention.

The refrigerant circuit 3 comprises a compressor 7 for compressing the refrigerant 4, a refrigerant/external air exchanger 8 for cooling the refrigerant 4 at constant pressure, for example placed at the front of the motor vehicle, an expansion member 9 to permit expansion of the refrigerant 4, and a heat exchanger 11 which is arranged to permit thermal transfer between the refrigerant 4 and the heat-transfer liquid 6.

The element 1 is in communication with a thermal exchanger 14, the thermal exchanger 14 being able to modify a temperature of the element 1, in particular by direct contact between the element 1 and the thermal exchanger 14, the thermal exchanger 14 being part of the heat-transfer liquid circuit 5.

The heat-transfer liquid circuit 5 comprises a pump 15 for making the heat-transfer liquid 6 circulate within the heat-transfer liquid circuit 5. The heat-transfer liquid circuit 5 comprises the heat exchanger 11, which is also part of the refrigerant circuit 3. The heat exchanger 11 comprises at least one first circulation path 21 for the refrigerant 4 and at least one second circulation path 22 for the heat-transfer liquid 6, the first circulation path 21 and the second circulation path 22 being arranged to permit a heat exchange between the refrigerant 4 present inside the first circulation path 21 and the heat-transfer liquid 6 present inside the second circulation path 22. Preferably, the heat exchanger 11 has several first circulation paths 21 and several second circulation paths 22. A first circulation path 21 is interposed between two second circulation paths 22, and a second circulation path 22 is interposed between two first circulation paths 21. The heat exchanger 11 thus has an alternating arrangement of first circulation paths 21 and second circulation paths 22.

Inside the heat-transfer liquid circuit 5, the heat-transfer liquid 6 flows from the pump 15 to the heat exchanger 11, then flows inside the heat exchanger 11, using the second circulation paths 22 to exchange heat energy with the refrigerant 4 present inside the first circulation paths 21, then flows inside the thermal exchanger 14, then returns to the pump 15.

Inside the refrigerant circuit 3, the refrigerant 4 flows from the compressor 7 to the refrigerant/external air exchanger 8, then to the expansion member 9. The refrigerant 4 then flows inside the heat exchanger 11, using the first circulation paths 21 inside which the refrigerant 4 exchanges heat energy with the heat-transfer liquid 6 present inside the second circulation paths 22, then returns to the compressor 7.

In FIG. 2, the heat exchanger 11 is parallelepipedal overall and comprises an end-plate 100 which is provided with a heat-transfer liquid admission point 101 by way of which the heat-transfer liquid 6 accesses the interior of the heat exchanger 11. The end-plate 100 is also provided with a heat-transfer liquid evacuation point 102 by way of which the heat-transfer liquid 6 is evacuated from the heat exchanger 11. The second circulation paths 22 extend between the heat-transfer liquid admission point 101 and the heat-transfer liquid evacuation point 102. The end-plate 100 also has a refrigerant admission point 103 by way of which the refrigerant 4 accesses the interior of the heat exchanger 11, and a refrigerant evacuation point 104 by way of which the refrigerant 4 is evacuated from the heat exchanger 11. The first circulation paths 21 extend between the refrigerant admission point 103 and the refrigerant evacuation point 104.

The heat exchanger 11 is a plate-type exchanger which comprises a plurality of plates 105, such as the plate 105 illustrated in FIG. 3. The plates 105 are engaged one inside the other in order to jointly delimit a tube 123 which channels a circulation of the refrigerant 4 or else of the heat-transfer liquid 6. In other words, the two plates 105 forming the tube 123 jointly delimit a channel 111 dedicated to the circulation of the refrigerant 4 or of the heat-transfer liquid 6. More particularly, one side of a plate 105 borders the channel 111 for circulation of the heat-transfer fluid 4 and the other side of the same plate 105 borders the channel 111 for circulation of the heat-transfer liquid 6. Thus, the plates 105 are mutually arranged in such a way as to alternately configure the channels 11 for circulation of the refrigerant 4 and of the heat-transfer liquid 6.

The plate 105 extends principally along an axis of longitudinal extent A1. The plate 105 comprises a bottom 106, and at least one raised edge 107 which surrounds the bottom 106. The bottom 106 extends within a bottom plane P5. The raised edge 107 is formed at the periphery of the bottom 106, and the raised edge 107 surrounds the bottom 106. The raised edge 107 intersects the bottom plane P5. It will be understood that the plate 105 is arranged in a generally rectangular tub, the bottom of the tub being formed by the bottom 106, and the edges of the tub being formed by the raised edge 107.

Such plates 105 are intended to be stacked in such a way that the bottoms 106 of the plates 105 are arranged parallel to each other, with a spaced-apart superpositioning of the bottoms 106. The raised edges 107 of two plates 105 nested one inside the other are in contact and are intended to be soldered to each other in order to ensure leaktightness of the channel 111 that is thus formed between two adjacent plates 105.

More particularly, the raised edge 107 comprises two longitudinal raised edges 108*a*, 108*b*, namely a first longitudinal raised edge 108*a* and a second longitudinal raised edge 108*b*, which are formed opposite each other. The raised edge 107 also comprises two lateral raised edges 109*a*, 109*b*, namely a first lateral raised edge 109*a* and a second lateral raised edge 109*b*, which are formed opposite each other.

In FIG. 4, the first lateral raised edge 109*a* extends in a first plane P1 which crosses the bottom plane P5 and which intersects the axis of longitudinal extent A1. Arranged longitudinally opposite the first lateral raised edge 109*a* is the second lateral raised edge 109*b*, which extends in a second plane P2, the second plane P2 crossing the bottom plane P5 and intersecting the axis of longitudinal extent A1.

The first longitudinal raised edge 108*a* extends in a third plane P3 which crosses the bottom plane P5 and which intersects an axis of lateral extent A2 of the plate 105, the axis of lateral extent A2 being orthogonal to the axis of longitudinal extent A1 and parallel to the bottom plane P5. The second longitudinal raised edge 108*b* extends in a fourth plane P4 which crosses the bottom plane P5 and which intersects the axis of longitudinal extent A2 of the plate 105.

By way of example, the first plane P1 forms, with the bottom plane P5, a first angle $\alpha$ of between 91° and 140°, preferably of between 91° and 95°. The second plane P2 forms, with the bottom plane P5, a second angle $\beta$ of between 91° and 140°, preferably of between 91° and 95°. The third plane P3 forms, with the bottom plane P5, a third angle $\gamma$ of between 91° and 140°, preferably of between 91° and 95°. The fourth plane P4 forms, with the bottom plane P5, a fourth angle $\delta$ of between 91° and 140°, preferably of between 91° and 95°. According to a design variant, the first angle $\alpha$, the second angle $\beta$, the third angle $\gamma$ and the fourth angle $\delta$ are equal, to within manufacturing tolerances.

In FIGS. 3 and 4, the plate 105 comprises four openings 110, preferably circular openings, which are distributed in pairs at each longitudinal end of the plate 105, more particularly at each of the corners of the bottom 106 of the plate 105. Two of these openings 110 are configured to communicate with one of the first circulation paths 21 formed at one side of the bottom 106, and the two other openings 110 are configured to communicate with one of the second circulation paths 22 formed at another side of the bottom 106.

Two of the openings 110 formed at the same longitudinal end of the plate 105 are each surrounded by a collar 120, such that these openings 110, encircled by this collar 120, extend in a plane that is offset with respect to a bottom plane P5 in which the bottom 106 is inscribed. The two other openings 110, situated at the other longitudinal end of the plate 105, extend in the bottom plane P5.

The bottom 106 comprises a rib 113, which is arranged such that the channel 111 has a U-shaped profile. The rib 113 is parallel to a first direction D of extent of the longitudinal raised edges 108*a*, 108*b*, the first direction D of extent of the longitudinal raised edges 108*a*, 108*b* being preferably parallel to the axis of longitudinal extent A1 of the plate 105. The rib 113 extends between a first longitudinal end 114 and a second longitudinal end 115, the first longitudinal end 114 being in contact with the lateral raised edge 109*a* that the raised edge 107 comprises. The second longitudinal end 115 is situated at a first non-zero distance D1 from the raised edge 107, the first distance D1 being taken between the second longitudinal end 115 and the lateral raised edge 109*b*, measured along the axis of longitudinal extent A1 of the plate 105. The first longitudinal end 114 of the rib 113 and the second longitudinal end 115 of the rib 113 are aligned along a first direction D parallel to an axis of longitudinal extent A1 of the plate 105.

These arrangements are such that the channel 111 is shaped as a U whose branches are parallel to the longitudinal raised edges 108*a*, 108*b* of the plate 105 and are separated by the rib 113, while the base of the U lies next to a second lateral edge 109*b* which is formed longitudinally opposite the first lateral edge 109*a*. The rib 113 is formed at an equal second distance D2 from the two longitudinal edges 108*a*, 108*b* of the plate 105, the second distance D2 being measured between the rib 113, taken at its center, and one of the longitudinal raised edges 108*a*, 108*b*, perpendicularly to the axis of longitudinal extent A1 of the plate 105.

According to one design variant, the rib 113 is offset by a non-zero distance with respect to a median plane P6 of the plate 105, the median plane P6 being orthogonal to the bottom 106 and parallel to the axis of longitudinal extent A1 of the plate 105, the distance being measured between the rib 113, taken at its center, and the median plane P6, perpendicularly to the latter.

In FIGS. 5 and 6, the rib 113 comprises two rib edges 141, which extend respectively between the bottom 106 and a summit 140 of the rib 113. The summit 140 is the part of the rib 113 at the greatest distance from the bottom 106. In other words, the summit 140 of the rib 113 is bordered longitudinally by the rib edges 141. The summit 140 is arranged as a plateau formed in a plane parallel to the bottom plane P5.

The rib 113 is advantageously of a sinuous configuration. In other words, the rib 113 is of a sinusoidal shape overall. It will be understood that a first ridge 142 which separates the summit 140 from any one of the rib edges 141 has a sinuous shape in a plane parallel to the bottom plane P5 and containing the summit 140. It will also be understood that a second ridge 143 which separates the bottom 106 from any one of the rib edges 141 has a sinuous shape in a plane parallel to the bottom plane P5 and containing the bottom 106.

The first ridge 142 and the second ridge 143 are not rectilinear. The first ridge 142 and the second ridge 143 of the same rib edge 141 are superposable on each other. It follows from this that each of the rib edges 141 is formed by an alternating sequence of humps and hollows. In other words, each of the rib edges 141 has the shape of a corrugated sheet. In other words too, each of the rib edges 141 comprises an alternating succession of convex portions 144 and concave portions 145, as can be seen in FIG. 5.

More particularly in FIG. 6, in a transverse plane P7 which is orthogonal to the bottom plane P5 and to the axis of longitudinal extent A1 of the plate 105, each of the rib edges 141 forms, with the bottom plane P5, a fifth angle σ of between 900 and 160°. In other words, the rib 113 has a trapezoidal profile in the transverse plane P7.

A rib width X, taken between the two rib edges 141 and parallel to the bottom plane P5, is constant from one to the other of the longitudinal ends 114, 115 of the rib 113.

Referring again to FIGS. 3, 4 and 5, the bottom 106 is provided with a plurality of protuberances 112 in order to disturb a flow of the refrigerant 4 or of the heat-transfer liquid 6 in the channel 111. These protuberances 112 form obstacles to a laminar flow of the refrigerant 4 or of the heat-transfer liquid 6 in the channel 111. Preferably, the protuberances 112 have a frustoconical profile in section in the transverse plane P7.

In FIGS. 3 and 5, the protuberances 112 are organized in a plurality of rectilinear rows 124*a* of protuberances 112, the rectilinear rows 124*a* being formed along a second direction D' which is parallel to the axis of lateral extent A2 of the plate 105. The successive rectilinear rows 124*a* alternately traverse a convex portion 144 or a concave portion 145 of the groove 113. A rectilinear character of a rectilinear row 124*a* of protuberances 112 stems from the fact that the rectilinear row 124*a* of protuberances 112 is orthogonal to the axis of longitudinal extent A1 of the plate 105.

The protuberances 112 are also organized in a plurality of oblique rows 124*b* of protuberances 112, the oblique rows 124*b* being formed along a third direction D" which forms, with the second direction D', a sixth angle φ, the sixth angle φ being the acute angle formed between the two directions D', D", which is of the order of 90°, to within manufacturing tolerances. The successive oblique rows 124*b* alternately traverse a convex portion 144 or a concave portion 145 of the groove 13. An oblique character of an oblique row 124*a* of protuberances 112 stems from the fact that the oblique row 124*b* of protuberances 112 is inclined by a non-zero angle with respect to the axis of longitudinal extent A1 of the plate 105.

It will be noted that a first distance E1 taken between a crown 146 of a convex portion 144 of the rib 113 and a protuberance 112 laterally nearest to the crown 146 is between 200% and 300% of a second distance E2 taken between a hollow 147 of a concave portion 145 of the rib 113 and a protuberance 112 laterally nearest to the hollow 147. In other words, the crown 146 of a convex portion 144 of the rib 113 is farther from the protuberance 112 laterally nearest to the crown 146 than are the hollow 147 of a concave portion 145 of the rib 113 and the protuberance 112 laterally nearest to the hollow 147.

The plate 105 is made of a metallic material able to be stamped in order to form in particular the protuberances 112 and the rib 113 by stamping of the plate 105, the metallic material being chosen from among the thermally conductive metallic materials, in particular aluminum or aluminum alloy.

The invention as has just been described does indeed achieve its set objectives, making it possible to homogenize the exchanges of heat along the entire length of the plate, thereby avoiding the zones of lesser exchange, for example along the rib 113 or along the longitudinal raised edges 108*a*, 108*b*, 208*a*, 208*b*.

The invention is not limited to the means and configurations exclusively described and illustrated, however, and also applies to all equivalent means or configurations and to any combination of such means or configurations. In particular, whilst the invention has been described here in its application to a heat exchanger involving refrigerant and heat-transfer liquid, it goes without saying that it applies to any shape and/or size of plate or to any type of fluid circulating along the plate according to the invention.

The invention claimed is:

1. A plate forming part of a heat exchanger and configured to delimit a U-shaped channel for circulation of a fluid, the plate extending principally along an axis of longitudinal extent and comprising:

a bottom provided with a plurality of protuberances;

a first lateral raised edge which is at least partially formed within a first plane intersecting the axis of longitudinal extent;

a second lateral raised edge parallel to, and formed opposite from, the first lateral raised edge;

first and second longitudinal raised edges formed opposite from one another and parallel to one another; and at least two openings which are configured such that the fluid enters and exits the channel, respectively, the bottom being provided with a rib which extends longitudinally from the first lateral raised edge, the rib being positioned between the two openings;

wherein the rib is of a sinuous configuration; and wherein the U-shaped channel includes two branches and a base;

each of the two branches being parallel to a corresponding one of the first and second longitudinal raised edges;

the base being adjacent to the second lateral raised edge, wherein the rib comprises two longitudinal ends, of which a first longitudinal end is in contact with the first lateral raised edge and a second longitudinal end is provided at a non-zero distance from the second lateral raised edge, wherein the base includes some of the protuberances and, between the second longitudinal end of the rib and the second lateral raised edge, is interrupted only by the protuberances, wherein the protuberances are organized in a plurality of rectilinear rows of protuberances and a plurality of oblique rows of protuberances, the rectilinear rows of protuberances being formed along a second direction (D') which is parallel to the axis of lateral extent of the plate and the oblique rows of protuberances being inclined by a non-zero angle with respect to the axis of longitudinal extent; and the plurality of rectilinear rows and the plurality of oblique rows are disposed in each of the two branches of the U-shaped channel and in the base of the U-shaped channel, wherein the second longitudinal end of the rib: is aligned along a first direction parallel to an axis of longitudinal extent of the plate and is further aligned with the first longitudinal end of the rib, wherein the second longitudinal end of the rib terminates in one of the rectilinear rows of protuberances without touching laterally nearest protuberances.

2. The plate as claimed in claim 1, wherein the first longitudinal end of the rib is aligned along the first direction parallel to the axis of longitudinal extent of the plate.

3. The plate as claimed in claim 1, wherein the rib has a summit which is positioned between two rib edges.

4. The plate as claimed in claim 3, wherein one at least of the rib edges comprises an alternating succession of convex portions and concave portions.

5. The plate as claimed in claim 3, wherein a rib width, taken between the two rib edges and parallel to a bottom plane within which the bottom is at least partially formed, is constant from one to the other of the longitudinal ends of the rib.

6. The plate as claimed in claim 4, wherein a first distance taken between a crown of a convex portion of the rib and a protuberance laterally nearest to the crown is between 200% and 300% of a second distance taken between a hollow of a concave portion of the rib and a protuberance laterally nearest to the hollow.

7. A heat exchanger comprising at least one plate forming part of the heat exchanger and configured to delimit a U-shaped channel for circulation of a fluid, the at least one plate extending principally along an axis of longitudinal extent and comprising:

a bottom provided with a plurality of protuberances, a first lateral raised edge which is at least partially formed within a first plane intersecting the axis of longitudinal extent, a second lateral raised edge parallel to, and formed opposite from, the first lateral raised edge, first and second longitudinal raised edges formed opposite from one another and parallel to one another, and at least two openings which are configured such that the fluid enters and exits the channel, respectively, the bottom being provided with a rib which extends longitudinally from the first lateral raised edge, the rib being positioned between the two openings, wherein the rib is of a sinuous configuration; and wherein the U-shaped channel includes two branches and a base;

each of the two branches being parallel to a corresponding one of the first and second longitudinal raised edges;

the base being adjacent to the second lateral raised edge, wherein the rib comprises two longitudinal ends, of which a first longitudinal end is in contact with the first lateral raised edge and a second longitudinal end is provided at a non-zero distance from the second lateral raised edge, wherein the base includes some of the protuberances and, between the second longitudinal end of the rib and the second lateral raised edge, is interrupted only by the protuberances, wherein the protuberances are organized in a plurality of rectilinear rows of protuberances and a plurality of oblique rows of protuberances, the rectilinear rows of protuberances being formed along a second direction (D') which is parallel to the axis of lateral extent of the plate and the oblique rows of protuberances being inclined by a non-zero angle with respect to the axis of longitudinal extent; and the plurality of rectilinear rows and the plurality of oblique rows are disposed in each of the two branches of the U-shaped channel and in the base of the U-shaped channel, wherein the second longitudinal end of the rib: is aligned along a first direction parallel to an axis of longitudinal extent of the plate and is further aligned with the first longitudinal end of the rib, wherein the second longitudinal end of the rib terminates in one of the rectilinear rows of protuberances without touching laterally nearest protuberances.

8. The plate as claimed in claim 1, wherein no additional rib is disposed between the second longitudinal end of the rib and the second lateral raised edge.

9. The heat exchanger as claimed in claim 7, wherein no additional rib is disposed between the second longitudinal end of the rib and the second lateral raised edge.

* * * * *